US010059897B2

(12) United States Patent
Sugimoto

(10) Patent No.: US 10,059,897 B2
(45) Date of Patent: Aug. 28, 2018

(54) FUEL ADDITIVE FOR INTERNAL COMBUSTION ENGINES AND FUEL COMPOSITION

(71) Applicant: TURBULENCE LTD., Tokyo (JP)

(72) Inventor: Shigeru Sugimoto, Tokyo (JP)

(73) Assignee: TURBULENCE LTD., Tokyo (JP)

( * ) Notice: Subject to any disclaimer, the term of this patent is extended or adjusted under 35 U.S.C. 154(b) by 0 days.

(21) Appl. No.: 15/317,861

(22) PCT Filed: Nov. 2, 2015

(86) PCT No.: PCT/JP2015/005497

§ 371 (c)(1),
(2) Date: Dec. 9, 2016

(87) PCT Pub. No.: WO2016/072079

PCT Pub. Date: May 12, 2016

(65) Prior Publication Data

US 2017/0145334 A1 May 25, 2017

(30) Foreign Application Priority Data

Nov. 7, 2014 (JP) ..... 2014-226644

(51) Int. Cl.

| | |
|---|---|
| ***C10L 10/08*** | (2006.01) |
| ***C10L 10/18*** | (2006.01) |
| ***C10L 1/222*** | (2006.01) |
| ***C10L 1/06*** | (2006.01) |
| ***C10L 1/08*** | (2006.01) |
| ***C10L 1/19*** | (2006.01) |

(52) U.S. Cl.

CPC ..... *C10L 10/08* (2013.01); *C10L 1/06* (2013.01); *C10L 1/08* (2013.01); *C10L 1/19* (2013.01); *C10L 1/222* (2013.01); *C10L 1/2222* (2013.01); *C10L 10/18* (2013.01); *C10L 2200/0423* (2013.01); *C10L 2200/0446* (2013.01); *C10L 2230/22* (2013.01); *C10L 2270/023* (2013.01); *C10L 2270/026* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,089,029 | A * | 2/1992 | Hashimoto | C10L 1/14 44/432 |
| 5,112,364 | A | 5/1992 | Rath et al. | |
| 6,117,197 | A | 9/2000 | Houser | |
| 6,224,642 | B1 | 5/2001 | Daly | |
| 6,299,655 | B1 | 10/2001 | Steckel et al. | |
| 7,435,272 | B2 | 10/2008 | Aradi et al. | |
| 2004/0010967 | A1 | 1/2004 | Aradi | |
| 2012/0260876 | A1 * | 10/2012 | Cooney | C10L 1/14 123/1 A |
| 2013/0023455 | A1 | 1/2013 | Habeeb | |

FOREIGN PATENT DOCUMENTS

| | | | |
|---|---|---|---|
| JP | H07-053972 | A | 2/1995 |
| JP | 2000-160173 | A | 6/2000 |
| JP | 2004-323821 | A | 11/2004 |
| WO | WO93/21289 | A1 | 10/1993 |

* cited by examiner

*Primary Examiner* — Ellen McAvoy
*Assistant Examiner* — Chantel Graham
(74) *Attorney, Agent, or Firm* — Takeo Ohashi

(57) ABSTRACT

Problem

A detergent friction modifying agent having both a detergent performance that ameliorates and prevents degradation over time that is caused by deposits in the engine, and a friction reducing effect that lowers frictional resistance in the engine; a fuel additive that improves drivability with a good balance over the entire range of engine speeds, and provides engine characteristics such that, over the entire range of driving speeds, the engine-braking characteristics are such that the feeling of free running will be strongly produced, such that a fuel consumption improvement effect is produced in actual vehicles that is greater than the values produced on the test bench, and which also has storage stability; and a fuel composition containing the same.

Solution

The present invention is characterized by containing a polyetheramine carboxylic acid salt; the fuel additive of the present invention is added to fuel at 0.5 wt % or less.

9 Claims, No Drawings

FUEL ADDITIVE FOR INTERNAL COMBUSTION ENGINES AND FUEL COMPOSITION

TECHNICAL FIELD

This invention relates to compositions which are useful as fuel additives and fuels, which prevent and improve the deterioration of fuel consumption for internal combustion engines caused by the secular change and degradation. And in order to improve the practical fuel consumption on the road, this invention provides not only reducing the engine friction but also to make the different drive feeling by changing engine-braking characteristics, which leads to release an accelerator throttle pedal earlier than usual. This invention also provides improvement of the stability of fuel additives in a single package.

BACKGROUND ART

In recent years, there have been remarkable advances in gasoline engines and various types of mechanisms having been applied and then the improvements of the fuel consumption of vehicles with gasoline engine have been astonishing. The driving forces for this can be classified into the two areas, and one is increasing of the combustion efficiency by higher compression ratios and improving charging efficiency, and the other is the reduction of the mechanical frictional losses.

The mechanisms for increases in combustion efficiency, by means of compression ratios and charging efficiencies are achieved by combining with direct injection mechanisms, in which gasoline is injected directly into the combustion chamber, and an Atkinson cycle, in which the expansion stroke is longer than the compression stroke, and for the above, exhaust gas recycling devices as well as variable valve-timing mechanisms are used.

In contrast with this, countermeasures for mechanical friction losses in the engine are achieved by way of two methods, which reduces the mechanical friction losses by way of the actual mechanisms and which depends on improved lubrication.

Reduction of friction loss by way of the actual mechanisms have already been taken to the limit, and as the result, by using supercharger systems for example, smaller displacement engines can be obtained greater output, it extends to the downsizing of the engine which controls a mechanical loss per output. In this case, because greater output is achieved with a smaller piston, it is a matter of course that the frictional resistance between the piston ring and the cylinder wall is greater than that of a conventional natural aspiration engine of the same displacement. Consequently, while higher lubrication performance is required, inevitably the internal frictional resistance becomes higher.

As the other device in countermeasures, reducing frictional loss between the piston ring and the cylinder wall by reduction of piston ring tension as less as possible is known as one trend. This is primarily used in natural aspiration engines. This kind of natural aspiration engines often use engine oils with lower viscosity and less agitating resistance. However, the oil film between the piston ring and the cylinder wall become thinner and the frictional resistance between these is conversely high.

Such mechanical systems are widely employed in engines, but in all of the systems used to achieve these characteristics, such as EGR and variable valve-timing mechanisms, direct injection, and other mechanisms, engine internal deposits occur more easily than in conventional engines, and thus these engines became more sensitive by secular change.

In case of engine oils, there is an effort to improve the friction reduction by means of lowering its viscosity and by using more friction modifier. However, just by increasing the amount of friction modifier lease to form the sludge in engine oil. Conversely, with a limited amount of friction modifier, the friction modifier consumes by driving distance and times, and the fuel saving effect of it gradually fades. The ILSAC, which establishes the fuel consumption improvement rates for international oil standards, has standardized fuel consumption improvement rates after 16 hours and after 96 hours, and every upgrade the specification, the fuel economy performance is required to be more longer duration, and the specification became more severe which requires more longer lubricity durations by way of improvements of engine oil formulations, but technology has still not been established which would allow for sufficient improvements in fuel economy over the entire life of the engine oil.

In order to compensate for these unsatisfied performance, by adding lubricity improver in to gasoline fuel, the making up technique for the lubricity performance of engine oil all the time has been introduced (more than 4% of improvement of the fuel consumption by adding friction modifiers into fuel were reported in the Bulletin of the 7th Fuel and Lubricating Oil Asia Conference.). However, in case of using one kind of lubricity improver or, the combination of several lubricity improvers, deposit of the intake system and intake valve deposit as well as combustion chambers deposit surely increase more than nothing.

Therefore, gasoline compositions together with detergent and friction modifiers have been introduced, for example, such as polybutenylamines, polyetheramines are used as the detergent. However, the combustion chamber deposit, which affect most on aging deterioration of engine performance, can be only effected by polyeteramine detergency.

The friction modifiers which put together with detergents are amines, amides and esters. Many ester-based friction modifiers, which are the most effective type among them, have been introduced, but ester-based friction modifiers cannot be stored for a long term together with detergents (particularly polyetheramine) due to internal reactions. s Because of the ester decomposition, for example, that the friction reducing effect cannot be maintained, and thus it is necessary to handle the friction modifiers and the detergent separately, or these to be added into the fuel immediately after the blend. Therefore, no formulations have been made which mix ester-based friction modifiers and detergents (for example, polyetheramines) together.

Technologies for improving fuel efficiency are known, not only in gasoline engines, but also in the most recent diesel engines, and are claimed (for example, see Patent Literature 1), but these are just only effect on the friction reduction of the engine internal parts (between the cylinder wall and the piston ring), and these technology have not yet obtained fully satisfactory effects on the practical fuel consumption, and thus there is a demand for better technologies, in diesel engines as well.

CITATION LIST

Patent Literature

PTL 1: description of JP-53-01116-B2
PTL 2: JP-11-310783-A
PTL 3: JP-06-062965-B2
PTL 4: JP-09-255973-B2
PLT 5: JP-11-310783-A

SUMMARY OF THE INVENTION

Technical Problem

Engines with the latest technologies tend to form the internal deposit more than conventional engines, and this deposit formation often deteriorates the fuel consumption compared with new vehicles'. And furthermore, the lubricity improved by fuel-saving engine oils is also degraded in mileage and times. Therefore, it is difficult to maintain the performance of new vehicles.

To compensate the above portions, various gasolines and fuel additives containing detergents and friction modifiers have been introduced a lot (for example, see Patent Literature 2). However, it has not been possible to achieve sufficient detergency and lubricity for the many various different types of engines, and thus sufficient effects have not been achieved.

Meanwhile, it cannot be said that these conventional gasolines and fuel additives have effectively reduced friction over the entire range of engine speeds used.

Furthermore, the various evaluation methods for the friction reduction performance usually measured simply by rig tests, or using chassis dynamometers etc. without consideration of the driver reaction from the changes of engine characteristics during practical driving. As the results, sufficient improvements in actual fuel consumption have not been achieved. Even if fuel additives are formulated just for reducing engine friction, in case of the nature of the changes in engine characteristics, which leads the driver to hit the gas pedal carelessly and as the result, the practical improvement of fuel consumption is very small in comparison with the effects from fuel consumption improvement measured by a chassis dynamometer or an engine alone.

Furthermore, in cases of making a single additive package mixed with polyetheramines, of which OGA480 and the like from Oronite that are typical in Japan and friction modifiers such as Lubirizol UZ9525A, which is a package type containing esters and amines, or glycerol monooleate, or its' mixture with amine-based friction modifiers, these packaging occur problems such as causing internal reactions, decomposition, and due to a lack of stability, long terms storage is not possible. Therefore, these must be handled separately. i.e. it is not only inconvenient for ordinary users to add these to gasoline, but also impossible to mix these at proper ratios.

For these reasons, these can be supplied to the refinery as the gasoline additives with relative ease. But these cannot be in one package, this increases manufacturing process even at refineries.

Furthermore, as discussed above, because the evaluation criteria for the performance of additives or fuels are obtained from simple rig tests or chassis dynamometers tests, the sufficient detergent capability and practical fuel consumption improvement effects cannot be found. For example, the gasoline sold in the Japanese market in the past, which aimed to improve detergency and practical fuel consumption, were evaluated on the automobile by moving just 10 m in parking, twice a day in the morning and the evening, over 3 months, and as a result, the engine could not be started due to the engine deposits inside. Thus, even with fuels treated by the addition of detergent and a friction modifier separately as a gasoline composition, it can not be said that the sufficient cleaning performance and the practical fuel consumption improvement effects were achieved.

After all, with the automobile technology alone (includes fuel saving engine oil), it is difficult to maintain the initial performance of the latest engines over long periods of time and in order to compensate for this, there is a demand for the fuel technology side not only to maintains the initial performance but also to effectively improve the fuel saving performance; but to date, in terms of sufficient detergent capability and practical fuel consumption, either a fuel additive or a fuel which can surely make a fuel consumption improvement effect has not yet been developed.

Further, depending upon various vehicle engine systems, such as an engine tend to get hot, or that always use on the cold condition, there are differences in the components and physical characteristics of the deposits itself on the intake valves and within the combustion chamber, therefore, even if polyetheramine is used alone as a detergent, it is not possible to achieve a sufficient effect for the various different types of engines. That is to say, in terms of detergent additives, there is a demand for detergents which are capable to a broad range of applicability.

Furthermore, in addition to the above, in terms of additives that can greatly contribute to practical fuel consumption, there is a demand for technology which surely contribute fuel consumption improvement, under consideration to the additive effects on engine performance characteristics, which also prevent and ameliorate deteriorating fuel consumption caused by deposit inside the engine due to aging.

Meanwhile, the engine with more complex mechanisms make a higher mechanical noise because the lower viscosity of engine oil is often used in order to achieve fuel consumption improvement effects, and then, these engines cannot be called quiet ones. In order to reduce the mechanical noise, the sound blocking covers etc. are used against the reduction of the weight of the car body, there is a demand for the technology which reduces mechanical noises as mach as possible.

In particular, in diesel engines, the fuel dilution at the cylinder walls caused by the multistage injection mechanisms and the deterioration of fuel consumption are the subject to discussion and thus, in the same manner as with gasoline engine, there is a demand for technology that reduces the frictional and wear between the cylinder wall and the piston ring, and for improvements in practical fuel consumption itself. At the same time, diesel fuel itself exposed to strong shearing and to high temperatures formed sludge, which tends to cause trouble in the fuel supply system, and thus there is a demand for new detergent agents.

In order to improve the detergent performance for the problem described above, the structure of the polyetheramine and the carbon number of the principal ether moiety are changed so as to improve the detergent performance (for example, see Patent Literature 3).

Further, by changing the molecular weight distribution, it is possible to somewhat expand the range of detergent capability (intake valves, fuel injection nozzles, combustion chambers) but changing molecular weight distribution to suit an objective has not only been extremely difficult in terms of manufacture, but it was difficult for a single polyetheramine to cover all of the various different engines with different mechanisms and characteristics.

Apart from this, it can be seen the literature which reported that among compositions for improving lubrication performance, the salts of fatty acids and aliphatic amines are more effective than fatty acids or aliphatic amines alone (for example, see Patent Literature 4). Although these show the improvement of lubricity, there were problems such as more deposits formation and the poor solubility at very low temperatures.

Solution to Problem

As a reflection of the problems described above and the result of earnest study, a novel additive containing a specific organic acid salt of a polyetheramine was discovered.

Specifically, this is a fuel additive characterized by comprising a carboxylic acid salt of a polyetheramine represented by General Formula (1):

$$[R_1—COO^-][R_2—O(AO)m—XH^+] \quad (1)$$

The carboxylic acid is a carboxylic acid wherein $R_1$ has 6 to 21 carbon atoms (hereafter $C_6$ to $C_{21}$), preferably $R_1$ has $C_7$ to $C_{19}$ and more preferably this is oleic acid where this $R_1$ has $C_{17}$. Note that the carboxylic acid component $R_1$ in the salt is a $C_7$ to $C_{21}$ chain hydrocarbon residue, which may be singular or constitute a mixture.

Furthermore, A may have a single carbon number in the molecule, or this may constitute a mixture of two or more kinds.

Furthermore, the polyetheramine having the base moiety is a compound represented by $R_2$—O(AO)m-X, where $R_2$ is a $C_8$ to $C_{50}$ hydrocarbon residue, A is a $C_2$ to $C_6$ alkylene group, O is oxygen, m is an integer in the range of 10 to 50, and X is an amino group or a hydrocarbon including a substituted amino group.

A may have single carbon number in the molecule, or may constitute a mixture of two or more kinds, and X is preferably $(C_3H_6NH)nH$, where n is an integer from 1 to 3.

Further, the polyether may have any molecular weight distribution. Furthermore, the structures of $R_2$ and X may constitute a salt in which polyetheramines having different structures are mixed.

The structure of the polyetheramine is preferably one wherein the A in (AO) is a $C_2$ to $C_4$ alkylene group, preferably $C_3$ to $C_4$, and more preferably $C_4$.

In comparison with polyetheramines that are not salts, the polyetheramine carboxylic acid salt described above demonstrates a more uniform capacity to dissolve deposits such as intake valves deposit upper piston and piston head, and even though the small amount of the carrier oil, it can maintain detergency especially against the intake valve deposit.

Consequently, carrier oils (mineral oil/synthetic oils) may have a possibility to deteriorate the detergency of detergents against the combustion chamber deposit, and the polyetheramine carboxylic acid salt can reduce the amount of carrier oils, thus an even detergency can be achieved both on the intake valves and on combustion chamber deposits by using the polyetheramine carboxylic acid salt. In general, approximately 10 to 25% by weight of carrier oil is normally necessary against detergent, the polyetheramine carboxylic acid salt can be reduced to less than half, at 5 to 10% or less. In some cases, even without carrier oil, sufficient cleaning performance can be achieved. In this case, synthetic oil should be used not mineral oils, and as the synthetic oils, especially-alkylene oxide adducts of alcohol or alkylphenol, alkylene oxide polymer, alkylene oxides adducts such as from propylene oxide, in particular from butylene oxide, and those ethers or esters are superior.

Meanwhile, the polyetheramine carboxylic acid salt, in particular the polyetheramine fatty acid salt, shows not only just detergency, but also performs as a friction modifier better than common ones and then, it shows a greater energy-saving effect. It should be noted that, from among the aforementioned fatty acid salts, the greatest friction reduction effect can be obtained with oleic acid salts.

Further, the great reduction of engine internal friction does not merely have an energy-saving effect, but also greatly impacts on the actual driving car characteristics.

For example, in case of driving at constant speed such as when driving on the highway, above reduction of engine internal friction makes the engine response more linearly against a small movement of the accelerator, and this change reduces excess stepping on the accelerator on uphill slopes. As the result, it can be obtained a fuel consumption reduction effect more than t conventional additives. On the other hand, because of the smooth acceleration on ordinal roads and in the city roads caused by great reduction of internal friction, it tends to step on the accelerator too much. This happens to make not to be obtained the same level of the fuel consumption reduction from the driving at high speed. Therefore, depending on the driver, it happens to be unsatisfied with an actual fuel consumption reduction effect.

Then, it was found that a different driving feel was produced by adding an ester to the polyetheramine carboxylic acid salt at the following ratios. Depending upon the change of the driving feel, it encourages more fuel-efficient driving.

Namely, by adding ester at the following ratio, for a weight $\alpha$ as the carboxylic acid which decomposed the polyetheramine carboxylic acid salt into the carboxylic acid and the polyetheramine, and for a weight $\beta$ of ester, in the range of $\beta/\alpha$ value=⅓ to 20/3, by weight ratio a change in engine characteristics is comes out, and the feeling of free running becomes stronger just before and after releasing the accelerator when decelerating, and also when accelerating, this combination produces a natural acceleration feeling. Thus during acceleration and deceleration, it leads not only to suppress the excessive step-in of the accelerator pedal, but also to release the accelerator pedal earlier. This feeling can be more strongly produced by way of adjustment of the combination of the polyetheramine fatty acid salt and the ester, within the range of ratios described above.

The ester is an ester of a $C_8$ to $C_{20}$ straight-chain fatty acid and a polyhydric alcohol, which is a dihydric to hexahydric alcohol, and as the ester, it is a monoester, a diester or a mixture thereof. And more preferably may be an ester principally comprising a monoester of the fatty acid, or a mixture of two or more different esters.

Here, when the weight of the carboxylic acid in the polyetheramine carboxylic acid salt is taken as $\alpha$, and the weight of the ester is taken as $\beta$, the $\beta/\alpha$ value, which is the ratio by weight, is no less than ⅓ and no greater than 20/3.

As a result, it is possible to improve actual fuel consumption a lot more than compared with the common formulations focused only on reducing the engine internal friction.

In order to produce this feeling more strongly, the ester is preferably a fatty acid monoester of a polyhydric alcohol, which is a dihydric or trihydric alcohol, and oleic acid, and more preferably a fatty acid monoester of glycerol as a trihydric alcohol and oleic acid, i.e. glycerol monooleate.

Furthermore, in case of conventional combinations of additives that reduce the engine internal friction, the ester described above coexisted with a polyetheramine causes turbidity, precipitation, etc. due to decomposition and substitution reactions, etc. which degraded performance.

On the other hand, formulations using a polyetheramine carboxylic acid salt alone, or polyetheramines containing polyetheramine carboxylic acid salts, inhibit the decomposition and degradation of the ester, and prevent turbidity and precipitation, allowing for long-term storage without degradation of the performance of the additive.

In this case, so long as this is a carboxylic acid salt, decomposition of the ester can be prevented, but in consideration of other properties, a fatty acid salt is more preferable. Here, the $R_1$ in the fatty acid represented by $R_1$—COOH is preferably $C_7$ to $C_{19}$. if less than $C_7$, this may cause rusting of the fuel tank, and if greater than $C_{19}$, the solubility of the polyetheramine fatty acid salt will be getting worse and cause the precipitates.

Note that, so long as $R_1$ is within this range, it is not necessary for the fatty acid that forms the salt to be a single fatty acid, but rather decomposition and so on of the fatty acid ester can be prevented with any kind of combination of fatty acids. However, in consideration of other properties for example such as lubricity, less carrier oil, and detergency, the fatty acid is preferably a $C_7$ to $C_{19}$, and more preferably $C_{11}$ to $C_{17}$ fatty acid, and still more preferably, oleic acid is selected.

In the process of finding a good combination of polyetheramine oleic acid salts and glycerol monooleate etc. in the pursuit of getting better fuel economy, as the amount of glycerol monooleate increases, consequently detergency especially on combustion chamber deposit CCD is getting worse. Then, by adding a polyetheramine, which is effective in removing CCD, it is possible to eliminate this negative aspect, but also to obtain a more suitable combination balance.

Here, technology improving fuel consumption by adding additives to diesel is know (for example, see Patent Literature 1). In the same manner as this, from among polyetheramine carboxylic acid salts, an evaluation was performed on polyetheramine fatty acid salts, and then, it was found that, with gasoline as well, a polyetheramine oleic acid salt is capable of improving fuel efficiency much more than by adding oleic acid alone, or by adding the combination of oleic acid and an aliphatic amine in diesel fuel.

At the same time, it was confirmed that polyetheramine fatty acid salts not only prevented the formation of sludge which leads to malfunction of the suction valve that controls the flow rate of the fuel pump, but also showed the excellent sludge removal performance. Furthermore, polyetheramine fatty acid salts is effective on ameliorating malfunctions due to sludge formation. In terms of the sludge removal improvement effect and the fuel consumption improvement effect, it was found that the effects were larger when a polyetheramine oleic acid salt was used as the fatty acid salt.

Based on the foregoing, disclosure is also made in the present invention of a fuel composition containing an additive, wherein that fuel is gasoline or diesel fuel, and the dosage against the fuel is from 20 ppm to 5,000 ppm.

Advantageous Effects of Invention

By adding the novel additive of the present invention to fuel, it shows a broad range of the detergency, and at the same time, it is possible to reduce the engine internal friction and others. Furthermore, the novel additive of the present invention improves the fuel economy much more than single conventional friction modifiers alone or the combination (for example, see Patent Literature 5) etc. that lower fuel consumption and at the same time it is also effective to the detergency over a broad range. Further, with the additive of the present invention, the additive itself is stable, and if it is mixed with other additives, it has the effect of preventing degradation such as decomposition and substitution reactions.

DETAIL DESCRIPTION OF INVENTION

The polyetheramine and the carboxylic acid are mixed with complete ratio of salting and the reaction forming the polyetheramine carboxylic acid salt was confirmed by changing the absorption spectrum using an FT/IR made by JASCO Corporation.

Note that, in the description, the term "ppm" refers to the dosage of the additive in the composition (for example, gasoline), equivalent to "1 mg/Kg=1 ppm."

When the carboxylic acid is added to the polyetheramine and stirred, as a salt gradually forms, the absorption spectrum at 1,720 to 1,700 $cm^{-1}$ clearly disappears/shifts which range of absorption spectrum comes from the typical C═O bond of carboxylic acids. That is to say, the generation of the polyetheramine carboxylic acid salt was clearly confirmed. This salt itself provides stability between additives and provides special properties to the fuel.

That is to say, the polyetheramine carboxylic acid salt shows lubricity but polyetheramine alone doesn't and in particular the salt with an oleic acid reduces engine internal friction much more than friction modifiers found in the past, together with wide range of detergency more than ever.

At the same time, in continuous use, from the intake valve up to the combustion chamber, it can show the effect of keeping clean. In addition to this, as it can suppress the carrier oil, which compensate the detergency at the intake valve deposit etc. at the minimum necessary level, it is more effective to remove the combustion chamber deposit. As the result, it is the polyetheramine carboxylic acid salts show wide range of detergency compared with conventional polyetheramines.

Furthermore, incase of conventional formulations, when a fatty acid ester was added to a detergent (polyetheramine/polyisobutylene amine), a turbidity and a precipitation occurred within several months to one year or so. In contrast, the polyetheramine carboxylic acid salt of the present invention, or a formulation containing a detergent such as a polyetheramine etc. which contains this, can suppress the occurrence of turbidity and precipitation significantly, when a fatty acid ester is added. Consequently, it is possible to make the more flexible formulation freely, while maintaining or improving the specific detergency of polyetheramines.

About the evaluation method of the improving fuel economy technology:

the conventional evaluation of the improving fuel economy technology for fuel additives and fuels containing fuel additives has been carried out just only attention to the reduction of the friction loss of the engine. However, because of the lack of the attention to finding the engine property change, it is hardly to say that the actual fuel economy has always been improved.

On the other hand, after the actual driving vehicle test has been confirmed repeatedly on the appropriate driving method (identical driving conditions, such as average speed) corresponding to the engine property change caused by gasoline containing polyetheramine carboxylic acid salts, especially containing polyetheramine oleic acid salt, the fuel economy improvement effect, that has never been achieved, was obtained.

Then, a lot of combinations with various friction modifiers were tested so that the driver would more naturally and unconsciously drive a car to fit its engine property which was created by reduction of the engine internal friction while considering to the effect of the drive feeling caused by engine property changes.

As a result, it was discovered that, in order to achieve better actual fuel economy improvement, rather than simply obtaining further reduction of the engine internal friction, adding the fatty acid ester resulted in a change in the engine-braking feel, such that, particularly at low speeds, a free running sense (free-running impression) was strongly felt just before releasing the accelerator pedal.

The increase of the free-running sense just before and just after releasing the accelerator pedal unconsciously leads driving wherein the driver releases the accelerator pedal earlier than usual. Because of no engine-braking effect even if easing up on the accelerator, if the accelerator pedal is released at the same timing as usual, the free driving distance becomes longer than expected, thus the brake pedal will be stepped on earlier, or strongly just before stopping, and the driver naturally feels uncomfortable. Consequently, by strongly producing this feel with the additive combination according to the present invention, the driver will unconsciously be caused to release the accelerator pedal at an earlier timing than in cases where there is no additive, or with fuel containing a conventional additive formulation. It is possible to greatly improve actual fuel consumption by way of guiding the driver in such a manner as "unconsciously earlier releasing accelerator pedal."

Then, in order to make the driver feel the free-running sense strongly, it is desirable that the ratio by weight of the fatty acid ester to the carboxylic acid moiety in the polyetheramine carboxylic acid salt is in the range between ⅓ or more and 20/3 or less, and preferably ⅔ or more and 20/3 or less. Even if 20/3 is exceeded, this sense will not be strengthened. What is more, deposits tend to form at the intake valves, and in the combustion chambers, etc. At less than ⅓, the subtle engine-braking feel fades out, and thus this does not lead improvements in actual fuel consumption.

When taking a balance of detergency and improvement of actual fuel economy performance, the detergency can be improved by increasing the polyetheramine content.

In this case, a polyetheramine may be added, that is the same or different molecular structure of the polyetheramine carboxylic acid salt, and in this case, by adding a polyetheramine having a different molecular structure so as to take advantage of the characteristics of the molecular structure of the polyetheramine, it is also possible to make a broader range of the detergency than the detergency from a single polyetheramine salt alone.

In particular, in case of the treatment such as one-tank clean up (to remove deposits by adding a detergent additive at high dosage into a fulfilled fuel tank) which removes the engine internal deposits, it is preferred to use polyetheramine carboxylic acid salts mixed with polyetheramines for immediate effect compared with using polyetheramine carboxylic acid salts alone.

In the case of diesel fuel, polyetheramine detergents as used in genuine products from many automakers are restricted exclusively for gasoline (Mazda's Genuine Product PEA and the like). That is to say, it has been stated that polyetheramine detergent are not suited for diesel engines. However, when fatty acid salts among from polyetheramine carboxylic acid salts, more preferably polyetheramine oleic acid salts are added into diesel fuel, the disadvantages are not found at all, and it is effective on removing the sludges form in all fuel lines of the fuel injection system, and at the same time it is possible to improve the lubricity of the diesel fuel.

Furthermore, in case of the common-rail diesel engine as the latest diesel engine, fuel adhesion on the cylinder wall caused by pre-injection etc. increase the friction between piston rings and cylinder walls. However, it can not only prevent friction increase but also reduce it. And the better fuel economy can be achieved than that of the conventional formulation with fatty acids and fatty amine.

Note that, detergents (regardless of the type or molecular structure) may be added to the additives or fuel compositions described above, and other additives that can be used in fuels as different friction modifiers, such as amines, amides, esters, and fatty acids, as well as corrosion inhibitor, dispersant, and solubilizing agents may be added, and in particular, with consideration for the handling of additives, these may be diluted with a solvent in order to reduce viscosity and facilitate adjustment of the dosage, there being no restrictions in terms of combinations with any other additives.

Hereafter, preferred embodiments of the present invention are described using examples.

Example 1

<Evaluation of Detergency>

Polyetheramine, the same polyetheramine salted with fatty acids containing no less than 50% of an oleic acid as a polyetheramine calboxylic acid salt, and polyetheramine with 10%, 25% of a nonylphenol butylene oxide polymer as the carrier oil, and 10% of the same polymer added to the polyetheramine carboxylic acid salt, were added to regular gasoline available in the market at the equivalent of 2,500 ppm as polyetheramine based in each, and the results of detergency against intake valve deposits and combustion chamber deposits are summarized in Table 1. A further two types of samples were evaluated in which the equivalent of 500 ppm of polyetheramine were added.

TABLE 1

Detergent test 1

| Sample No. | Additive composition | Deposit removal status: Intake valve | Deposit removal status: Combustion chamber |
|---|---|---|---|
| 1-1 | polyetheramine | Δ | Δ |
| 1-2 | polyetheramine + carrier oil 10% | ○ | ○ |
| 1-3 | polyetheramine + carrier oil 25% | ◎ | Δ |
| 1-4 | polyetheramine carboxylic acid salt | ○ | ○ |
| 1-5 | polyetheramine carboxylic acid salt + carrier oil 10% | ◎ | ○ |
| 1-6 | sample 4 + polyetheramine | ◎ | ◎ |
| 1-7 | sample 5 + polyetheramine | ◎ | ◎ |

legend
◎: excellent,
○: good,
Δ: poor

In the evaluation described above, the Subaru generator SGi25S was used. Before evaluation for each candidate, deposits were formed by 50 hours operation with gasoline which contains 3% of engine oil, and then, evaluation was carried out for 50 hours by means of changing the load every one hour. Note that Synthesis Example 1 described in JP-06-062965-B was used as the polyetheramine.

Example 2

<Evaluation of Dissolution of Intake Valve Deposits and Combustion Chamber Deposits>

Deposits from the IVT and CCD were immersed in undiluted solutions of the polyetheramine, the polyetheramine oleic acid salt and a polyetheramine caprylic acid salt at different temperatures, and the degree of dissolution was evaluated.

The polyetheramine and the salt thereof ([$R_2$—O(AO)m-$XH^+$]) used in the evaluation was that with the best balance wherein $R_2$=13, A=4 ($C_4$ alkylene group), m=20, and for X, n=1 was used.

TABLE 2

Detergent test 2

| Sample No. | Undiluted solution composition | IVD (intake valve deposit) evaluation Undiluted solution temperature 60° C. | 120° C. | CCD (combustion chamber deposit) evaluation Undiluted solution temperature 60° C. | 120° C. |
|---|---|---|---|---|---|
| 2-1 | PEA | ◎ | ○ | ◎ | ○ |
| 2-2 | PEA oleic acid salt | ◎ | ◎ | ◎ | ◎ |
| 2-3 | PEA caprylic acid salt | ○ | ◎ | ○ | ◎ |

legend

◎: excellent,

○: good

Example 3

<Evaluation of the Fuel Consumption Improvement Effect of Polyetheramine Carboxylic Acid Salts> actual fuel consumption was measured by using various different engines with polyetheramine, polyetheramine carboxylic acid salts (crude oleic acids containing fatty acid mixture as the carboxylic acid), fatty acids (the same crude oleic acids containing fatty acid mixture in the same amount in the carboxylic salts), and polyetheramine cyclohexanoic acid salt at the equivalent of 1,000 ppm (as the dosage in regular gasoline) of polyetheramine. A polyetheramine wherein $R_2$=13, A=4 ($C_4$ alkylene group), m=20, and for X, n=1 was used.

TABLE 3

Comparison of fuel consumption with polyetheramine carboxylic acid salt salts

| Sample No. | Additive composition | Average fuel consumption improvement rate |
|---|---|---|
| 3-1 | polyetheramine | 0% |
| 3-2 | polyetheramine fatty acid salt | 6.30% |
| 3-3 | fatty acid | 2.90% |
| 3-4 | polyetheramine cyclohexanoic acid salt | 0.80% |

The values in Table 3 are average values, primarily measured by driving on the highways, with a 150 cc single-cylinder engine, a 250 cc four-cylinder engine, a 1300 cc four-cylinder engine, a 1,300 cc direct-injection engine, and a 2,000 cc four-cylinder turbocharged engine.

The engine internal deposits of each vehicle were removed in advance with polyetheramine, and the tests were performed after determining the standard fuel consumption without additives. In all cases, the fuel used was regular gasoline that did not contain additives. These are average values for each vehicle making a 100 km two-way trip at 20 to 25 times.

Example 4

From among the polyetheramine carboxylic acid salts, the salts with fatty acids containing 90% or more of oleic acid which shows the higher fuel consumption improvement effects and the salts with fatty acids containing 99% or more of caprylic acid were used and fuel consumption measurements were performed A polyetheramine wherein $R_2$=13, A=4 ($C_4$ alkylene group), m=20, and for X, n=1 was used The dosage of each sample was equivalent to 1000 ppm of polyetheramine (as the dosage in regular gasoline).

TABLE 4

Fuel consumption improvement effect with polyetheramine fatty acid salts

| Sample No. | Additive composition | Average fuel consumption improvement rate |
|---|---|---|
| 4-1 | PEA | 0% |
| 4-2 | PEA oleic acid salt | 7.20% |
| 4-3 | PEA caprylic acid salt | 1.10% |

In the test described above, the values were obtained by driving suited to the changes in engine behavior with the same vehicles as in Example 2. In terms of the polyetheramine salts, salts were made with the same polyetheramine as in Example 3, and fatty acids containing 90% oleic acid, or 99% caprylic acid, respectively.

The polyetheramine fatty acid salts have a fuel consumption improvement effect, but with $C_{19}$ and higher fatty acids, the solubility of the additive itself is insufficient and some precipitates. Likewise, among fatty acid salts containing oleic acid, the higher concentration of the oleic acid is preferable. That is to say, it was found that polyetheramine oleic acid salts had the greatest fuel economy improvement effect.

Example 5

<Evaluation of Differences in Fuel Economy Improvement Rates in High-Speed Driving and on Ordinary Roads where Vehicles Repeatedly Start and Stop>

However, in cases of driving in cities where acceleration and deceleration is repeated, when polyetheramine fatty acid salts are used, it improves the engine response more, and the fuel economy improvement rates may not s be always the same as that in high-speed driving due to stepping on the accelerator pedal more often and the like. Hereafter, from among Example 4, two types of vehicles, with a fuel-efficient engine and a high power type engine were compared. The salt was made from a fatty acid containing no less than 90% oleic acid and the same polyetheramine as in Example 3. The dosage as the polyetheramine content was 500 ppm w/w (dosage in regular gasoline).

TABLE 5

Evaluation of changes in fuel consumption improvement rates due to driving conditions (average fuel consumption improvement rate with Honda PCX150/Yamaha Majesty S)

| Driving category | Fuel consumption improvement rate |
|---|---|
| high-speed driving/300 km/average | 7.10% |
| in-town driving/280 km/average | 5.80% |

As shown by the results in Table 5, in in-town driving, where the accelerator pedal is frequently turned on and off, the fuel consumption was found to improve less than expected.

Example 6

<Evaluation of the Change in Engine-Braking Free-Running Feel at Low Speeds, and the Effect on Actual Fuel Consumption, with Fatty Acid Esters>

Based on the evaluation in Example 5, minimization of the engine-braking effect just before gas pedal release at lower speeds was studied.

Specifically, esters were added to the polyetheramine carboxylic acid salt.

Samples were made by varying the ratios at which esters were added, which is a ratio by weight of $\beta/\alpha$, where the weight of the ester is $\beta$, and where the weight in terms of the carboxylic acid in the polyetheramine carboxylic acid salt is $\alpha$.

An ester containing no less than 95 wt % of glycerol monooleate was used. A polyetheramine oleic acid salt was used as the polyetheramine carboxylic acid salt. The dosage of the polyetheramine oleic acid salt was 500 ppm w/w in all cases. The evaluation target was the free-running feel.

TABLE 6

Engine-braking evaluation and actual fuel consumption

| Sample No. | Additive wherein glycerol monooleate was added to polyetheramine oleic acid salt $\beta/\alpha$ value | Free-running feel evaluation Speed (per hour) 30 km | 40 km | 60 km | 80 km | Fuel consumption improvement rate |
|---|---|---|---|---|---|---|
| 6-1 | 0 | Δ | Δ | ○ | ◎ | 5.80% |
| 6-2 | 1/2 | X | Δ | Δ | ○ | 5.60% |
| 6-3 | 3/3 | ○ | Δ | Δ | ○ | 6.10% |
| 6-4 | 9/3 | ◎ | ◎ | ○ | ◎ | 7.40% |
| 6-5 | 21/3 | ◎ | ◎ | ○ | ◎ | 7.40% |

legend

◎: excellent,

○: good,

Δ: fair,

X: poor

For the evaluation vehicles, a 1,300 cc four-cylinder 129 kW high-power engine motorcycle; a 1,300 cc, 14:1 high compression ratio direct-injection engine; a 2,000 cc turbo, 149 kW manual vehicle; a 250 cc four-cylinder motorcycle; and a 150 cc scooter were used, and the results for the vehicles were comprehensively evaluated.

A polyetheramine wherein $R_2$=13, A=4 ($C_4$ alkylene group), m=20, and for X, n=1 was used.

Example 7

<Engine Deposit Suppressant Effect Rresulting from Additives that Combine Polyetheramine Carboxylic Acid Salts, Esters and Polyetheramines>

When a glycerol monooleate (concentration: 95 wt %) as the ester was mixed at the aforementioned $\beta/\alpha$ of 20/3 or more, the detergency of the polyetheramine carboxylic acid became worse and the intake valve deposits and the combustion chamber deposits increased drastically and therefore there was no advantage to adding this in an excessive amount.

Conversely, if the overall dosage mixed with polyetheramine carboxylic acid salt and the ester is increased more than necessary, it does not mean that the detergency is improved. Here, it was discovered that, in such cases, it is possible to compensate for the degradation of the detergency.

TABLE 7

Effects of fatty acid ester on CCD and detergency of polyetheramine fatty acid salts (CCD: combustion chamber deposit) evaluation)

| Sample No. | Mixture of polyetheramine oleic acid salt and glycerol monooleate $\beta/\alpha$ value | Polyetheramine addition | CCD (combustion chamber deposit) evaluation |
|---|---|---|---|
| 7-1 | 0 | no | ◎ |
| 7-2 | 9/3 | no | ◎ |

TABLE 7-continued

| Effects of fatty acid ester on CCD and detergency of polyetheramine fatty acid salts (CCD: combustion chamber deposit) evaluation) | | | |
|---|---|---|---|
| Sample No. | Mixture of polyetheramine oleic acid salt and glycerol monooleate β/α value | Polyetheramine addition | CCD (combustion chamber deposit) evaluation |
| 7-3 | 20/3 | no | ○ |
| 7-4 | 21/3 | no | Δ |
| 7-5 | 20/3 | yes | ◎ |

legend
◎: excellent,
○: good,
Δ: fair

A Subaru generator was used as the evaluation equipment. The evaluation was carried out with regular gasoline with 1,500 ppm w/w of a polyetheramine oleic acid salt as the polyetheramine carboxylic acid salt. Further, the amount of additionally added polyetheramine was 500 ppm w/w with the above regular gasoline containing the polyetheramine oleic acid.

Here, it was found that combustion chamber deposits, CCD, start to increase when the β/α value began to be exceeded 20/3. Furthermore, in terms of the impact on the engine-braking feel, even if the β/α value was increased beyond this, there was no change, and thus there is no advantage to adding the ester and the polyetheramine fatty acid salt in excess of 20/3. As the β/α value is getting close to 20/3, the CCD gradually increased. Sample No. 7-5 is one wherein a single PEA, polyetheramine, was additionally added, and it was found that the deterioration of the CCD was ameliorated by adding the polyetheramine, and thus it was possible to enhance detergency for more diverse systems.

A polyetheramine wherein $R_2$=13, A=4 ($C_4$ alkylene group), m=20, and for X, n=1 was used.

Example 8

<Storage Stability Tests>

Polyetheramine carboxylic acid salt alone has many advantages, but in order to provide a variety of performance, it may be combined with ester-based friction modifiers and amine-based or amide-based additives.

With conventional formulations, when ester-based additives were present together with amine compounds, the stability became worse, and in particular, when combined with detergents (polyetheramines, polyisobutyl amines and the like), turbidity occurred and precipitation is produced. and particularly in the case of additives for the aftermarket, it is not possible to store long-term, and not fit for the aftermarket. For this reason, in order to produce multi-functional performance, the formulations with detergents were restricted.

In this regard, it was found that the formulations that contain polyetheramine carboxylic acid salts together with ester-based additives can prevent turbidity and precipitation etc., and it became possible to make a free combinations.

For the storage stability tests, polyetheramine carboxylic acid salts were made with various carboxylic acids, i.e. oleic acid (total carbon number: $C_{18}$), caprylic acid (total carbon number: $C_8$), behenic acid (total carbon number: $C_{22}$), cyclohexanoic acid (total carbon number: $C_7$). As the ester, glycerol monooleate was blended in at the aforementioned β/α value of 3 (9/3).

Addition to the above candidates, single polyetheramine was added to each at approximately 50 wt % of the polyetheramine in the polyetheramine carboxylic acid salt and tested. Furthermore, Polyisobutylene amine alone at, the same total base number as the polyetheramine (Sample 8-10), and this with polyetheramine oleic acid salt at a ratio by weight of 1:1 (Sample 8-11) were also evaluated. Glycerol monooleate was added to all of these samples at the β/α value of 3 (9/3).

TABLE 8

| Storage stability tests | | | | | | |
|---|---|---|---|---|---|---|
| | | | | Storage stability | | |
| Sample No. | Main additives | Addition of approximately 50 wt % PEA | β/α value | After one month | After 3 months | After one year |
| 8-1 | PEA | no | 3 | haze | precipitation | decomposition and precipitation |
| 8-2 | PEA oleic acid salt | no | 3 | clear | clear | clear |
| 8-3 | PEA caprylic acid salt | no | 3 | clear | clear | clear |
| 8-4 | PEA behenic acid salt | no | 3 | clear | slight haze | haze |
| 8-5 | PEA cyclohexanoic acid salt | no | 3 | clear | clear | clear |
| 8-6 | PEA oleic acid salt | yes | 3 | clear | clear | clear |
| 8-7 | PEA caprylic acid salt | yes | 3 | clear | clear | clear |
| 8-8 | PEA behenic acid salt | yes | 3 | clear | haze | precipitation |
| 8-9 | PEA cyclohexanoic acid salt | yes | 3 | clear | clear | slight haze |

TABLE 8-continued

| Storage stability tests | | | | | | |
|---|---|---|---|---|---|---|
| | | | | Storage stability | | |
| Sample No. | Main additives | Addition of approximately 50 wt % PEA | β/α value | After one month | After 3 months | After one year |
| 8-10 | polyisobutylene amine | no | 3 | haze | precipitation | precipitation |
| 8-11 | polyisobutylene amine + PEA oleic acid salt | no | 3 | clear | clear | clear |

PEA: polyetheramine

When carboxylic acid containing the total number of carbon atoms of 22 or more is used, the solubility of the polyetheramine carboxylic acid salt itself becomes inferior. At the same time the effect of preventing internal reactions is getting weak. The effect of preventing precipitation by adding the polyetheramine carboxylic acid salt is effective not only for polyetheramine, but also for polyisobutylene amine.

Example 9

<Overall Fuel Consumption Evaluation>

Just polyetheramine alone is added at 25 wt % into polyetheramine oleic acid salt and into this, as the ester, glycerol mono oleate (GMO) was also added at the ratio by 3 times of the oleic acid in the salt, and this is added into gasoline at a ratio by weight of 500 ppm with respect to the gasoline, and this was taken as Sample 9-1. Sample 9-1 without containing the glycerol mono oleate was taken as Sample 9-2. Evaluation was performed for the various gasolines with oleic acid alone (Sample 9-3), glycerol mono oleate alone (Sample 9-4), a mixture of these (Sample 9-5), a mixture of polyetheramine that is not a salt with glycerol mono oleate (Sample 9-6) and further a composition wherein oleylamine, as a friction-modifying fatty acid amine, was added in an amount that was the same as that of the glycerol mono oleate (ester) (Sample 9-7).

In terms of the evaluation method, the evaluation was performed using the additives (Sample 9-1 to Sample 9-7) on distances of 100 km on the highway and 150 km on ordinary roads, 10 times each, with gasoline without additives as reference.

Average values for actual fuel consumption improvement rates were obtained. In terms of the test vehicle, engines are a fuel-efficient 150 cc single-cylinder engine; a 1,300 cc 176 horsepower, natural aspiration four-cylinder engine; and a 1,300 cc direct injection, common-rail, four-cylinder engine with a compression ratio of 14:1 and the like.

TABLE 9

| Overall fuel consumption evaluation results | | |
|---|---|---|
| Sample No. | Additive composition | Average actual fuel consumption improvement rate |
| 9-1 | polyetheramine oleic acid salt + GMO | 7.20% |
| 9-2 | polyetheramine oleic acid salt | 4.80% |
| 9-3 | oleic acid | 1.80% |
| 9-4 | GMO | 2.90% |

TABLE 9-continued

| Overall fuel consumption evaluation results | | |
|---|---|---|
| Sample No. | Additive composition | Average actual fuel consumption improvement rate |
| 9-5 | oleic acid + GMO | 1.00% |
| 9-6 | polyetheramine + GMO | 3.20% |
| 9-7 | polyetheramine + GMO + oleylamine | 3.10% |

NB:

GMO = glycerol mono oleate

It was found that the composition wherein a suitable ester was combined with the polyetheramine oleic acid salt (Sample 9-1) achieved improvement in fuel consumption greater than the composition of the polyetheramine oleic acid salt alone (Sample 9-2). Further, it was found that the effects were incomparably superior to those of the conventional composition of oleic acid alone (Sample 9-3), the ester alone (Sample 9-4), or the mixture of these (Sample 9-6). Next, it was found that, a drastic fuel consumption improvement effect was achieved, even in comparison with the composition containing the polyetheramine and the ester, which are said to have a synergistic effect (Sample 9-6) and with the conventional compositions containing oleylamine and the like was added (Sample 9-7).

Example 10

<Evaluation of the Fuel Consumption Improvement Effect>

In order to further clarify the effect of the polyetheramine carboxylic acid salt, in order to confirm how fuel consumption is influenced in terms of each of polyetheramine and carboxylic acid, the influences on fuel consumption and other effects of polyetheramine oleic acid salt, polyetheramine, and oleic acid alone were tested.

Fuels containing polyetheramine at 200 ppm and 400 ppm were taken as Samples 10-1 and 10-2, and fuel containing fatty acids with 80% of oleic acid concentration at 50 ppm as the carboxylic acid, was taken as Sample 10-3, and the fuel consumption improvement effect was studied by comparison with fuels without these additives.

TABLE 10

| Fuel consumption improvement effect of polyetheramine and oleic acid | | |
|---|---|---|
| Sample No. | Additive (parts per million by weight in fuel) | Fuel consumption improvement effects in high-speed driving |
| 10-1 | polyetheramine (200 ppm) | 0.00% |
| 10-2 | polyetheramine (400 ppm) | 0.00% |
| 10-3 | fatty acid (50 ppm) | 2.20% |

In terms of the evaluation method, a drive computer was used for a 1,300 cc four-cylinder 176 horsepowered large motorcycle, and the average values during driving 300 Km under the same conditions were used. The same polyetheramine as in Example 3 was used.

In addition, a composition was made so that 50% of the oleic acid would form a salt with the polyetheramine, and this was added into gasoline fuel at 250 ppm by weight (corresponding to 225 ppm in polyetheramine oleic acid salt and 25 ppm of oleic acid) and this was taken as Sample 11-1, while the polyetheramine oleic acid salt was added into gasoline fuel at 450 ppm by weight (this salt is 100% of the 50 ppm of oleic acid had formed a salt with the polyetheramine) and this was taken as Sample 11-2, and these were evaluated. In terms of the evaluation method, a drive computer was used for a 1,300 cc four-cylinder 176 horsepowered large motorcycle, and the average values during driving 300 Km under the same conditions were used. The same polyetheramine as in Example 3 was used.

TABLE 11

| Fuel consumption effects of fatty acid salts and fatty acids | | |
|---|---|---|
| Sample No. | Additive (parts per million by weight in fuel) | Fuel consumption improvement effects in high-speed driving |
| 11-1 | polyetheramine oleic acid salt + fatty acid (250 ppm (corresponding to 225 ppm + 25 ppm)) | 3.40% |
| 11-2 | polyetheramine oleic acid salt (450 ppm) | 4.30% |

From these results it was found that the composition wherein 100% of the oleic acid had formed a polyetheramine oleic acid salt (Sample 11-2) had a greater fuel consumption improvement effect than the composition in which the oleic acid formed a polyetheramine oleic acid salt at a ratio of 50% (Sample 11-1).

It is judged that, rather than a synergistic effect being produced when the oleic acid and the polyetheramine are both present, in fact the polyether oleic acid salt itself produces the fuel consumption improvement effect. That is to say, the polyetheramine carboxylic acid salt itself can be said to produce the fuel consumption improvement effect.

Example 11

<Effect of Reducing Mechanical Noise of the Engine>

The polyetheramine carboxylic acid salt greatly reduces mechanical noise of the engine, and particularly noise around the valves.

Meanwhile, with direct-injection, high-compression injection engines which have become more common in gasoline vehicles in recent years, the sound of the fuel injector and the like can be heard to a considerable extent.

However, by adding the polyetheramine carboxylic acid salt (Sample 12-2), an effect of greatly reducing these noises is achieved, and more quiet engine performance can be produced. Further, a composition wherein an ester containing glycerol mono oleate 50% and glycerol dioleate 40% is added to the polyetheramine carboxylic acid salt with a $\beta/\alpha$ value of 10/3 (Sample 12-3) produced an effect of further reducing mechanical noise.

TABLE 12

| Noise effect | | | |
|---|---|---|---|
| Sample No. | Additive | Maximum noise level (dBA) | Minimum noise level (dBA) |
| 12-1 | no additives | 76.5 | 73.2 |
| 12-2 | polyetheramine fatty acid salt | 70.1 | 68.5 |
| 12-3 | polyetheramine fatty acid salt + ester | 69.5 | 68 |

In terms of the evaluation method, a 1.3 L, direct-injection, gasoline engine with a high compression ratio of 14:1 was used, and measurements were carried out at around 30 cm from the top of the engine.

A polyetheramine wherein $R_2$=13, A=4 ($C_4$ alkylene group), m=20, and for X, n=1 was used, and a salt was made with a fatty acid containing 80% oleic acid, which was added to gasoline so as to produce a concentration of 500 ppm, and this was evaluated.

A composition of 50% glycerol monooleate, 40% glycerol dioleate and the remaining being 10% triglycerol was used as the ester.

Example 12

<Evaluation for Diesel: Complete Test of Engine Stalling due to Sludge Built Up in the Suction Control Valve>

These are the results of adding the polyetheramine carboxylic acid salt that demonstrated good results in gasoline engines to diesel fuel at 1,500 ppm and driving a Toyota Hiace 200 Series with a common-rail diesel engine using the above fuel. This tested car frequently had engine stalls at the start.

TABLE 13

| Changes in the number of engine stalls (effect of improving initial problem in suction control valve) | | | | |
|---|---|---|---|---|
| Sample No. | Addition of additive to vehicle | Additive dosage | Number of stalls | Driving distance |
| 13-1 | vehicle before using additive | 0 ppm | 14 times (number of times before test) | 0 km |

TABLE 13-continued

| Changes in the number of engine stalls (effect of improving initial problem in suction control valve) | | | | |
|---|---|---|---|---|
| Sample No. | Addition of additive to vehicle | Additive dosage | Number of stalls | Driving distance |
| 13-2 | addition of additive (first time) | 1,500 ppm | 0 times | 0 km to 2,000 km |
| 13-3 | addition of additive (second time) | 250 ppm | 0 times | 2,000 km to 7,000 km |
| 13-4 | no additives | 0 ppm | 2 times | 7,000 km to 9,000 km |

In terms of the evaluation, a Toyota Hiace 200 Series, 2.5 L common-rail diesel vehicle was used as the test vehicle. The diesel fuel used for both Samples 13-1 and 13-4 is market available diesel fuel.

The first evaluation (Sample 13-2) was one in which, for the polyetheramine carboxylic acid salt, a salt was made using a composition including no less than 80% oleic acid, and an additive containing this salt was added to market available diesel fuel at an additive dosage of 1,500 ppm. Engine stalling occurrence was evaluated by driving for 2,000 km. Engine stalling entirely ceased to occur in this driving, and when 5,000 km was subsequently driven with an additive dosage of 250 ppm, engine stalling likewise did not occur.

That is to say, the malfunction caused by sludge that was the cause of engine stalling due to suction control valve failure was improved and it was possible to prevent engine stalling. Note that sludge is formed primarily due to the composition of diesel fuel.

Thereafter, the additive dosage was reduced to 250 ppm w/w and test was performed for 5000 km as a second evaluation, engine stalling did not occur.

Subsequently, during driving for 2,000 km with market available diesel fuel, engine stalling reoccurred close to 2,000 km. Upon immediately switching to diesel fuel containing the additive, it was possible to avoid the engine stall symptoms immediately thereafter.

From the foregoing facts it can be said that, at high dosage, polyetheramine oleic acid salt removes sludge on the suction valve, and prevents the formation of sludge, and at low concentrations, it prevents the formation and adhesion of sludge, and thus can prevent occurrence of engine stalls. Meanwhile, when changing the diesel fuel with additives back to the market available diesel fuel without additive, the trouble occurred again, thus it found that the diesel fuel with polyetheramine oleic acid salt demonstrated the performance which could not found in market available diesel fuel.

As above, by way of evaluation tests using actual vehicles which were already known to have problems, when the diesel fuel containing the additive from the present invention is used, it was evidenced that both (1) detergent performance and (2) lubricity are provided, such as (1) sludge removing properties and, (2) improvement and prevention of the malfunction of the suction control valves caused by insufficient lubricity of the diesel fuel and sludge formation by improved diesel fuel lubricity.

Example 13

<Fuel Consumption Improvement Effect in Common-Rail Diesel Engines>

TABLE 14

| Fuel consumption improvement at fixed speed | | | | |
|---|---|---|---|---|
| Sample No. | Additive | Dosage | 40 km/hour | 80 km/hour |
| 14-1 | polyetheramine oleic acid salt | 1,500 ppm | 7.30% | 6.80% |

In terms of the evaluation method, the auto cruise function on a Peugeot 307 HDi 137 was used, and driving in the same location, the amount of fuel consumption was measured with a drive computer. Note that, by driving at the same road section 5 times, the average value was found so as not to be influenced by wind or the like.

As a result of this evaluation test, it was found that a fuel consumption improvement effect and a cleaning effect were achieved in the same manner as with gasoline vehicles, even with a common-rail diesel.

CONCLUSIONS

The effects of the polyetheramine carboxylic acid salt are multifold, covering detergent properties, storage stability, fuel economy improvement and changes in engine characteristics.

These properties are largely dependent mainly on the type of carboxylic acid.

The following table summarizes, in a manner that is easy to understand, the key performance for additives containing the polyetheramine carboxylic acid salt according to the present invention and conventional additives.

TABLE 15

| Sample No. | Additive | Storage stability | Detergency | Energy savings | Noise reduction effect |
|---|---|---|---|---|---|
| 15-1 | PEA | — | ○ | X | X |
| 15-2 | PEA caprylic acid salt | ◎ | ○ | Δ | X |
| 15-3 | PEA oleic acid salt | ◎ | ◎ | ○ | ○ |

TABLE 15-continued

| Sample No. | Additive | Storage stability | Detergency | Energy savings | Noise reduction effect |
|---|---|---|---|---|---|
| 15-4 | PEA cyclohexanoic acid salt | ○ | Δ | Δ | X |
| 15-5 | PEA caprylic acid salt + ester | ◎ | ○ | ○ | Δ |
| 15-6 | PEA oleic acid salt + ester | ◎ | ○ | ◎ | ◎ |
| 15-7 | PEA cyclohexanoic acid salt + ester | Δ | X | Δ | Δ |
| 15-8 | PEA + ester | X | Δ | Δ | Δ |
| 15-9 | PEA oleic acid salt + ester + PEA | ◎ | ◎ | ◎ | ◎ |

PEA: polyetheramine
legend
◎: excellent,
○: good,
Δ: fair,
X: poor

It can be said that, from among the polyetheramine carboxylic acid salts, polyetheramine oleic acid salts demonstrate excellent performance in many respects Even with combination with esters which significantly improve practical fuel consumption by changing the drive feel (free-running feel) to the driver, the additives do not cause internal reactions or the like, thus it allows to make formulations more freely, as the results it is possible to achieve energy-saving effects that could not be obtained conventionally.

At the same time, even with the balance of detergent performance, it is possible to make more highly stable formulations.

Furthermore, detergent performance and fuel consumption improvement effect are also achieved with diesel fuel.

Note that regular gasoline was used for all the evaluation tests described above.

Also in the evaluation tests described above, when not specifically stated, the polyetheramines are the polyetheramine salts used were all those wherein $R_2$=13, A=4 ($C_4$ Alkylene group), m=20, and for X, n=1.

Furthermore, derivatives of branched tridecanol, which is to say $(CH_3CH(CH_3)((CH_2CH(CH_3))_2CH(CH_3)(CH_2)_2OH)$, synthesized by the oxo process, can be used for the polyetheramine (PEA) where $R_2$=13 ($C_{13}$).

Furthermore, in terms of examples of the structural formula of this polyetheramine (PEA), an example of a structural formula wherein $R_2$=13, A=4 ($C_4$ alkylene group), m=20, and for X, n=1 is as follows.

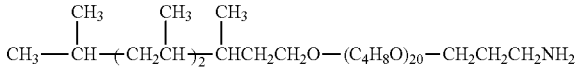

Furthermore, in terms of the polyetheramine (PEA), substances where $R_2$=8 ($C_8$) including octanol, which is to say n-octanol ($CH_3(CH_2)_7OH$) and 2-ethylhexanol ($CH_3(CH_2)_3CH(C_2H_5)CH_2OH$) were used.

What is claimed is:

1. A fuel additive for internal combustion engines, wherein the additive comprises a polyetheramine carboxylic acid salt represented by General formula (1), $$[R_1—COO—][R_2—O(AO)m—XH^+] \quad (1)$$

wherein $R_1$ is a hydrocarbon residue containing 7 to 21 carbon atoms, the polyetheramine moiety having a base component is a compound represented by $R_2$—O(AO)m-X (where $R_2$ is a hydrocarbon residue containing of 8 to 50 carbon atoms, A is an alkylene group containing 2 to 6 carbon atoms, O is oxygen, m is an integer of 10 to 50, and X is an amino group or a hydrocarbon including a substituted amino group), and X is $(C_3H_6NH)nH$ where n is an integer of 1 to 3.

2. An additive, wherein the additive comprises the additive according to claim 1 and a mineral oil, a synthetic oil, an ester, a polyetheramine or a mixture of any combination thereof.

3. An additive according to claim 2 containing the ester, wherein a ratio by weight β/α is no less than 1/3 and no greater than 20/3, where α is the weight of the carboxylic acid in the polyetheramine carboxylic acid salt, and β is the weight of the ester.

4. A fuel composition comprising an additive according to claim 1.

5. A fuel composition according to claim 4, wherein the fuel is gasoline or diesel and 20 ppm to 5,000 ppm of the additive is added.

6. A fuel composition comprising an additive according to claim 2.

7. A fuel composition according to claim 6, wherein the fuel is gasoline or diesel fuel and 20 ppm to 5,000 ppm of the additive are added.

8. A fuel composition comprising an additive according to claim 3.

9. A fuel composition according to claim 8, wherein the fuel is gasoline or diesel fuel and 20 ppm to 5,000 ppm of the additive are added.

* * * * *